US010132546B2

(12) United States Patent
Drach et al.

(10) Patent No.: US 10,132,546 B2
(45) **Date of Patent: *Nov. 20, 2018**

(54) TWO-PLANE DOOR FOR REFRIGERATOR COMPARTMENT

(71) Applicant: Whirlpool Corporation, Benton Harbor, MI (US)

(72) Inventors: Deron M. Drach, Evansville, IN (US); Eric D. Lively, Eberfeld, IN (US); Garett L. Strandemo, Evansville, IN (US); Eric W. Kost, Evansville, IN (US); Julie A. Mann, Haubstadt, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 205 days.

This patent is subject to a terminal disclaimer.

(21) Appl. No.: 15/188,606

(22) Filed: Jun. 21, 2016

(65) Prior Publication Data

US 2016/0298895 A1 Oct. 13, 2016

Related U.S. Application Data

(63) Continuation of application No. 13/748,807, filed on Jan. 24, 2013, now Pat. No. 9,441,873.

(51) Int. Cl.

| | |
|---|---|
| ***F25C 5/00*** | (2018.01) |
| ***F25C 5/20*** | (2018.01) |
| ***F25D 23/04*** | (2006.01) |
| ***E06B 3/32*** | (2006.01) |
| ***E06B 7/00*** | (2006.01) |
| ***F25D 23/12*** | (2006.01) |
| ***F25C 1/00*** | (2006.01) |
| ***F25D 23/02*** | (2006.01) |
| *F25D 17/06* | (2006.01) |
| *F25C 5/18* | (2018.01) |

(52) U.S. Cl.

CPC ..... *F25C 5/24* (2018.01); *E06B 3/325* (2013.01); *E06B 7/00* (2013.01); *F25C 1/00* (2013.01); *F25C 5/22* (2018.01); *F25D 23/02* (2013.01); *F25D 23/028* (2013.01); *F25D 23/04* (2013.01); *F25D 23/12* (2013.01); *F25C 5/18* (2013.01); *F25C 2400/04* (2013.01); *F25D 17/065* (2013.01); *F25D 2317/061* (2013.01); *F25D 2317/067* (2013.01); *F25D 2323/021* (2013.01); *F25D 2400/04* (2013.01)

(58) Field of Classification Search

CPC ..... F25C 5/005; F25C 2400/04; F25C 5/24; E06B 3/325; E06B 7/00; F25D 23/04

See application file for complete search history.

(56) References Cited

U.S. PATENT DOCUMENTS

2010/0262295 A1 10/2010 Lee

*Primary Examiner* — Orlando E Aviles Bosques

(74) *Attorney, Agent, or Firm* — Nyemaster Goode, P.C.

(57) ABSTRACT

In a refrigeration appliance, an enclosure or container defines an enclosed space. A two-plane door forms a portion of the container. The two-plane door opens along one pivot axis and allows access to the enclosed interior space. The container can be a thermally insulated in-door ice compartment of a refrigerated appliance. One example is a bottom freezer style, with the in-door ice compartment in the cold food section of the appliance.

18 Claims, 16 Drawing Sheets

TWO-PLANE DOOR FOR REFRIGERATOR COMPARTMENT

CROSS REFERENCE TO RELATED APPLICATIONS

This application is a continuation of and claims priority to U.S. patent application Ser. No. 13/748,807, filed on Jan. 24, 2013, entitled "TWO-PLANE DOOR FOR A REFRIGERATOR COMPARTMENT," the disclosure of which is hereby incorporated herein by reference in its entirety.

BACKGROUND OF THE INVENTION

Field of the Invention

The present invention relates to refrigerator appliances, and in particular, to compartments and doors for compartments inside a refrigerator appliance.

Related Art

Innovation continues regarding configurations of refrigerators and refrigerator/freezers. One example is the types of compartments, storage structures, and functional features inside the appliance. Another example is the basic nature of the appliance itself. Top freezer or side-by-side refrigerator/freezer configurations have now been joined by bottom freezer and what are called by some "French door" bottom freezer type configurations. In the latter case, the freezer compartment is on the bottom of the appliance. The cold food section is on top. Two opposably swinging doors open up to one large cold food compartment the width and depth of the cabinet of the appliance.

To deliver features that consumers demand in these different appliance configurations is not a trivial matter. There are many competing and sometimes antagonistic factors involved.

One example is the highly-demanded feature of an automatic ice maker. To form ice, the ice-making compartment must be maintained at below-freezing temperatures developed by the appliance. This requires appropriate communication with cold air of that temperature. In contrast, the cold food section of the appliance must be supplied air at a higher temperature. Additionally, the ice maker must deposit the made ice into a container or ice bucket that also must be maintained at sub-freezing temperatures. This can be a challenge if the ice bucket is not in the freezer section.

Another example of the complexities of automatic ice making exists for the French door-type refrigerator with bottom freezer. For obvious reasons, access to the ice bucket is preferred by many to be at least at waist height or higher. A bottom freezer, of course, is lower than this. An ice maker or ice bucket outside of the freezer compartment requires delivering sub-freezing cooling away from the freezer compartment. It also requires maintaining those temperatures at the ice maker and ice bucket even though outside the freezer.

Placement of the ice bucket is in the door of the refrigerated compartment is a still further complexity. The usual gravity drop of ice from the ice maker into the ice bucket is not a trivial endeavor. Nor is creating sub-freezing temperatures at both the ice maker and ice bucket. Generally, there is a requirement of an ice container or insulated wall surrounding the ice bucket. But this can be antagonistic with, for example, user access to the ice in the ice bucket.

All of these factors must also be taken in the context that it is generally desirable to minimize material and manufacturing costs and to maximize usable space within the refrigerator appliance.

It can therefore be seen that there are many competing considerations for the designer of such appliances. Such competing interests and factors can also exist for other containers in refrigerators.

SUMMARY OF THE INVENTION

It is therefore a principle object, feature, aspect, or advantage of the present invention to improve over or solve problems and deficiencies in the state of the art.

Other objects, features, aspects, or advantages of the present invention pertain to a container in a refrigerator appliance that:

a. provides reasonable access to the space inside the container;

b. can enclose a space but still allow good utilization of the space;

c. has good durability and robustness, including for the temperature and humidity conditions in the interior of a refrigerated appliance;

d. can, if needed, effectively interface with other components such as, for one example, an ice maker;

e. is economical to make and assemble; and f. can be functionally and aesthetically beneficial in a refrigeration appliance.

According to an aspect of the present invention, an enclosure inside of a refrigerated appliance includes walls defining a volume of enclosed three-dimensional space. One of the walls comprises a door that, when opened, exposes front and top portions of the three-dimensional space.

According to another aspect of the present invention, an enclosure in a refrigerated applicant includes a door that has a first section in a first plane and a second section in a second plane. In one form, the first plane is generally vertical and the second plane is oblique to vertical.

According to another aspect of the present invention, a door to an in-door insulated ice container includes a lower section in a generally vertical plane and an upper section oblique to vertical.

According to another aspect of the present invention, a refrigerated appliance comprises a bottom freezer type appliance. An ice maker is in the refrigerated food compartment. An insulated ice compartment is on the inside of a door to the refrigerated food compartment. The ice maker has an angled front face. The ice compartment has a front door with a lower vertical section and an upper oblique section. The upper oblique section of the ice compartment door is complementary to the angled front face of the ice maker. When the refrigerator door is shut, the oblique ice compartment door section abuts the angled face of the ice maker in a complementary fashion. An opening in the oblique ice compartment door section allows ice to fall by gravity from the ice maker into the ice compartment. Access to the ice compartment is allowed by opening of the ice compartment two-plane door when the refrigerator door is open.

These and other objects, features, aspects, and advantages of the present invention will become more apparent with reference to the accompanying specification and claims.

DETAILED DESCRIPTION OF EXEMPLARY EMBODIMENT

Overview

Figure 1A:
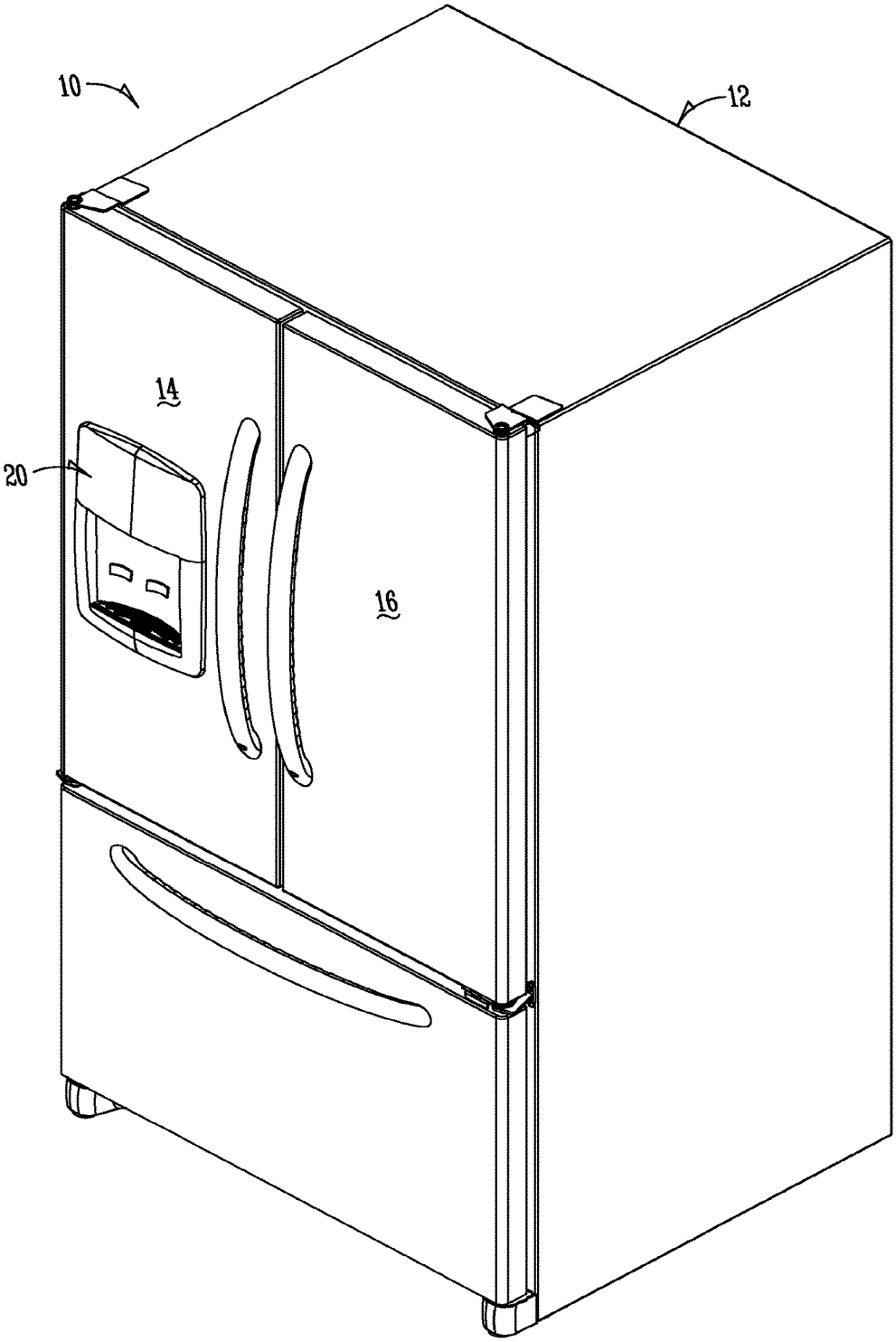
FIG. 1A is a perspective view of a French door, bottom freezer type refrigerated appliance such, including French doors covering the cold food compartment and an ice/water dispenser on the front of that door.

For a better understanding of the invention, a specific example of one form the invention can take will now be described in detail. Frequent reference will be made the drawings summarized in the previous section. Reference numbers and letters will be used to indicate certain parts or location in the drawings.

One aspect of the invention relates to what will be called the "two-plane door". Generally, the door is a part of an enclosure or compartment. A first section of the door can be substantially in a first plane. A second portion of the door is at least substantially in a second plane. In one embodiment, that second plane is oblique to the first plane and a hinge or other connection that allows pivoting opening of the door attaches the door to its enclosure or compartment along one side of the first section of the door, providing a pivot axis that is at least generally parallel to the first plane.

In the exemplary embodiment discussed below, the two-plane door is a part of an ice container in-door the refrigerated food compartment of a refrigerated food appliance. However, it is to be understood that the two-plane door can be applied to other containing functions within the refrigeration appliance. Specifically, the exemplary embodiments will be discussed in the context of what is known sometimes as a "French-door, bottom-freezer" refrigerator appliance. The ice container is a thermally insulated enclosure on the inside of left-side door to the refrigerated food compartment of the appliance. An icemaker is mounted just below roofline inside the cabinet of this particular exemplary appliance. The ice compartment includes an opening that abuts the ice maker when refrigerator door is closed; allowing ice to be dispensed by gravity into ice compartment and sub-freezing air to be directed into the ice compartment. The insulated walls of the ice compartment promote maintenance of sub-freezing temperatures in that compartment.

It is to be understood, however, that aspects of the invention can be applied to refrigerated appliances other than French-door, bottom freezer types.

General Example of Apparatus

Figure 1B:
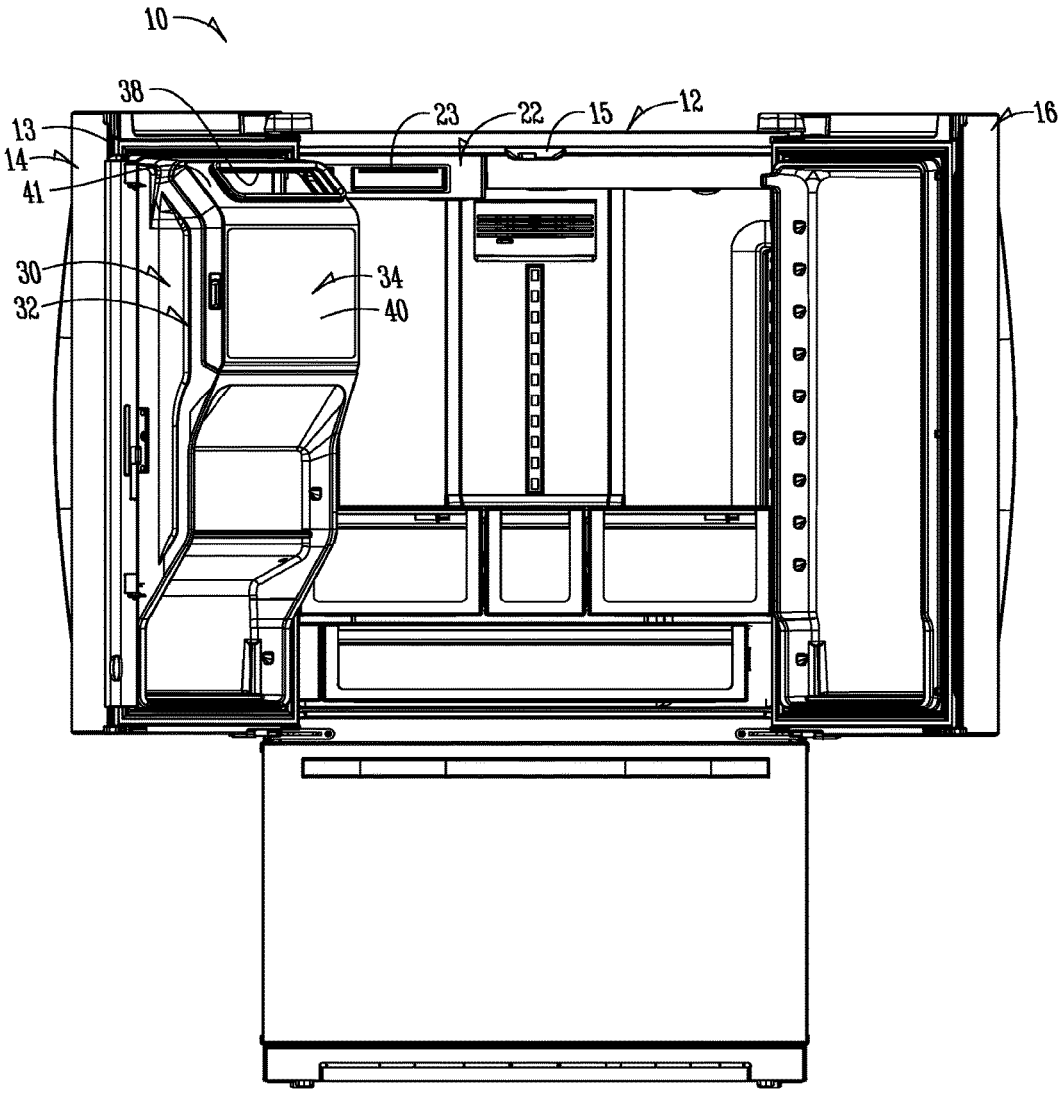
FIG. 1B is a front elevation of the appliance of FIG. 1A with French doors open, showing an automatic ice maker in the refrigeration section, an ice bucket enclosed by an ice container on the inside of one of the French doors, all according to an exemplary embodiment of the present invention.
Figure 1C:
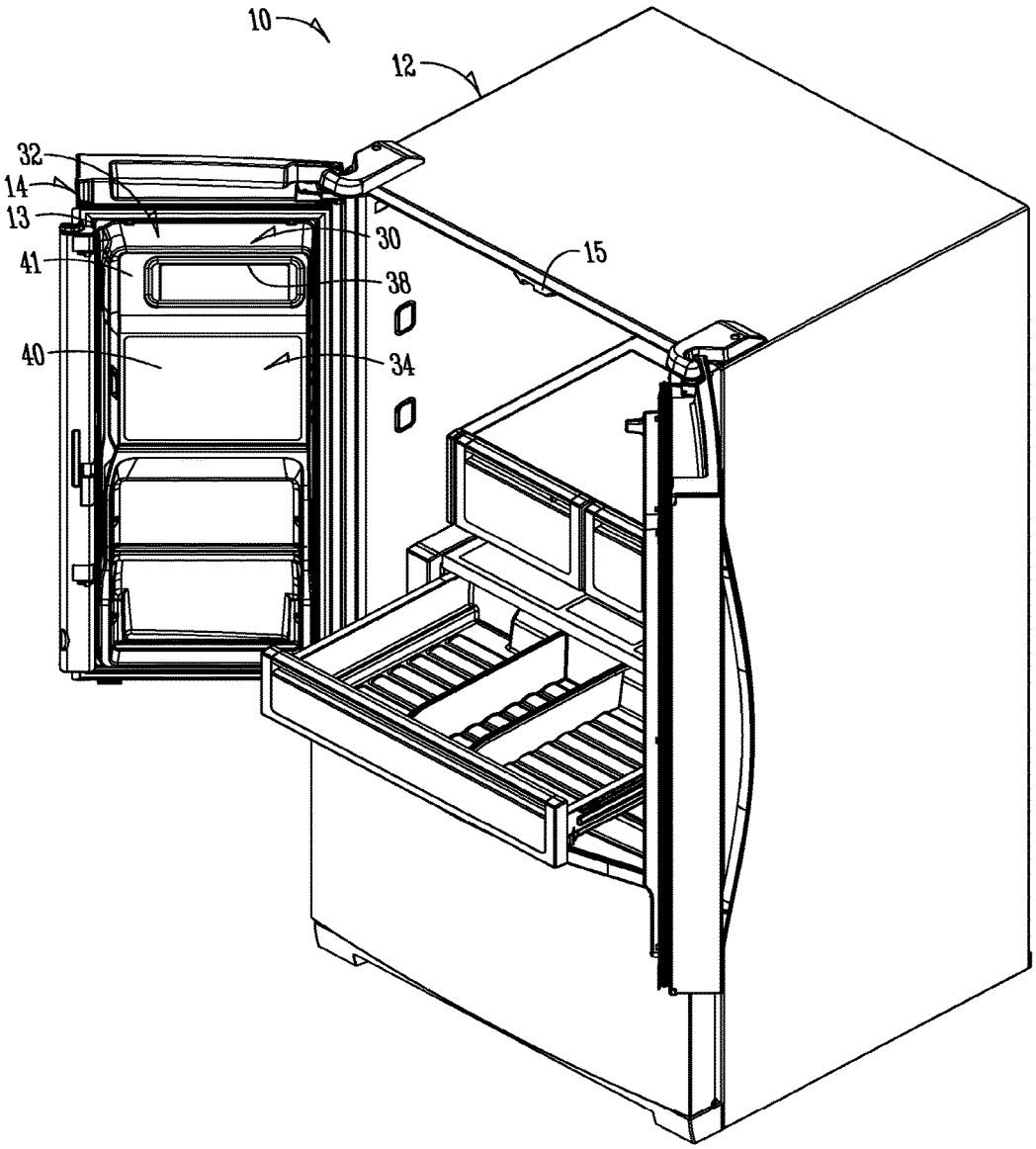
FIG. 1C is a perspective view of the appliance of FIG. 1B from a different viewing direction showing a two-plane door to the in-door ice compartment.
Figure 1D:
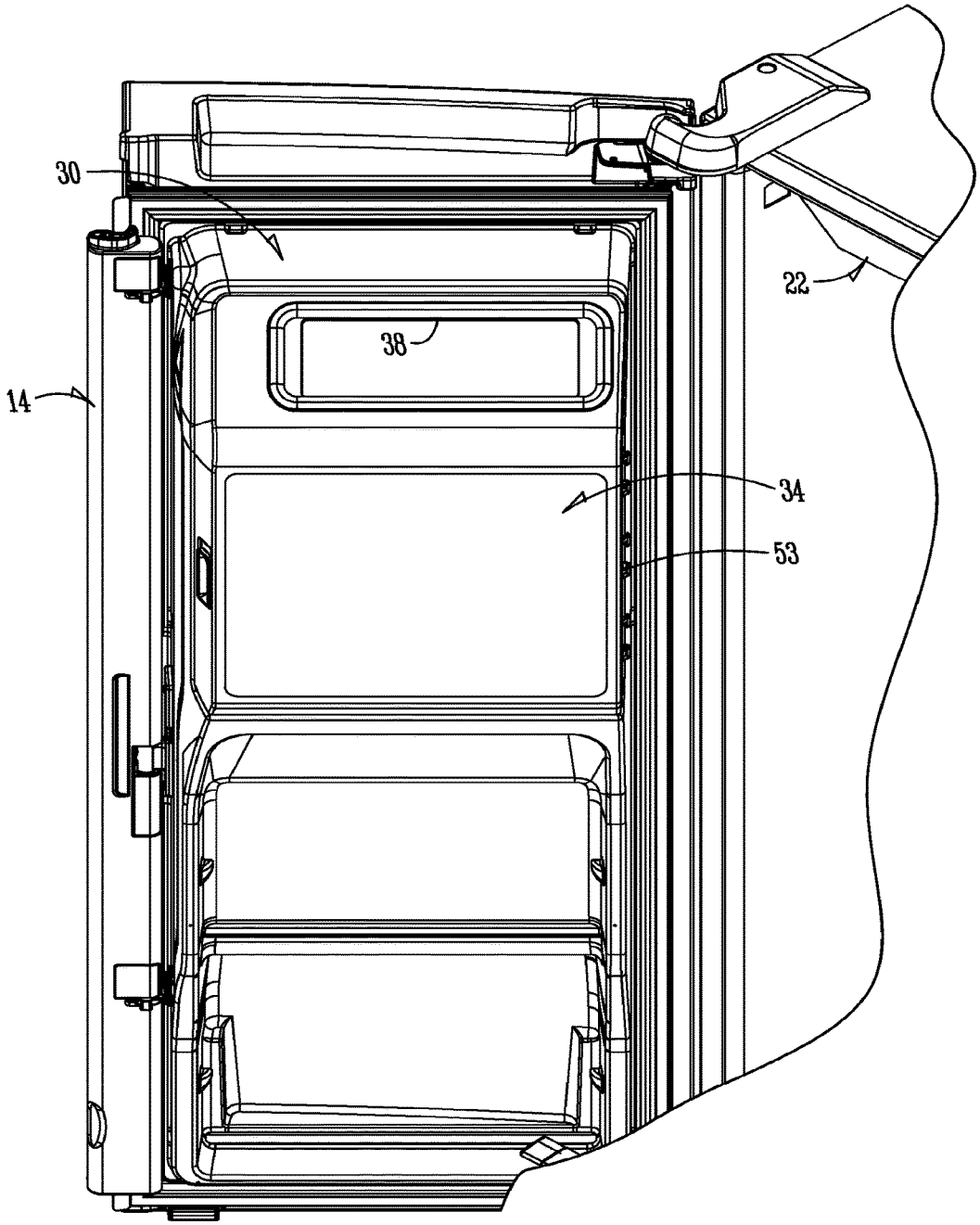
FIG. 1D is an enlarged isolated elevation view of the in-door ice compartment and two-plane door of FIGS. 1B and C.
Figure 1E:
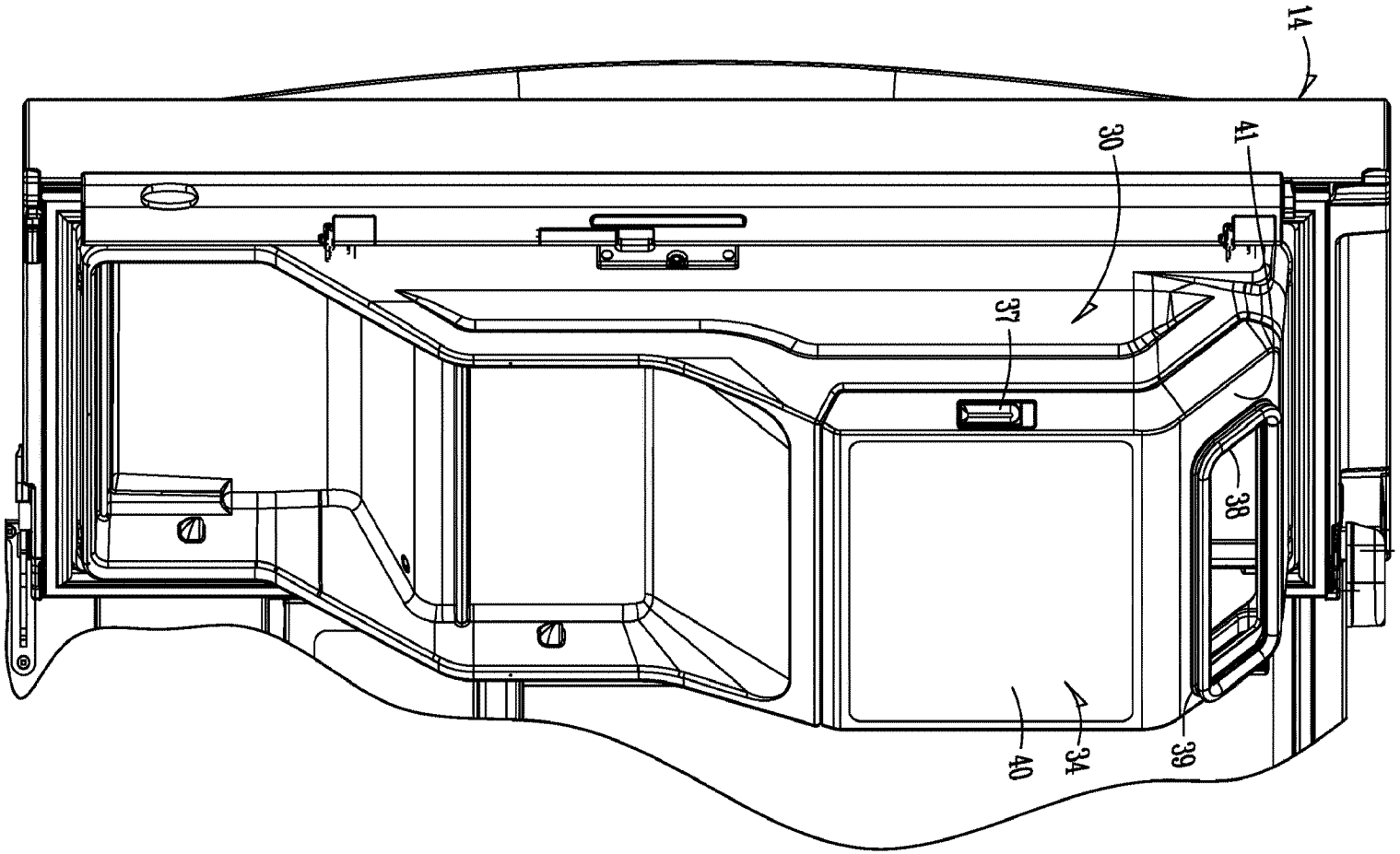
FIG. 1E is a perspective view of the ice compartment of FIG. 1D, showing the two-plane door to the ice compartment; the door having portions in two different planes.
Figure 7:
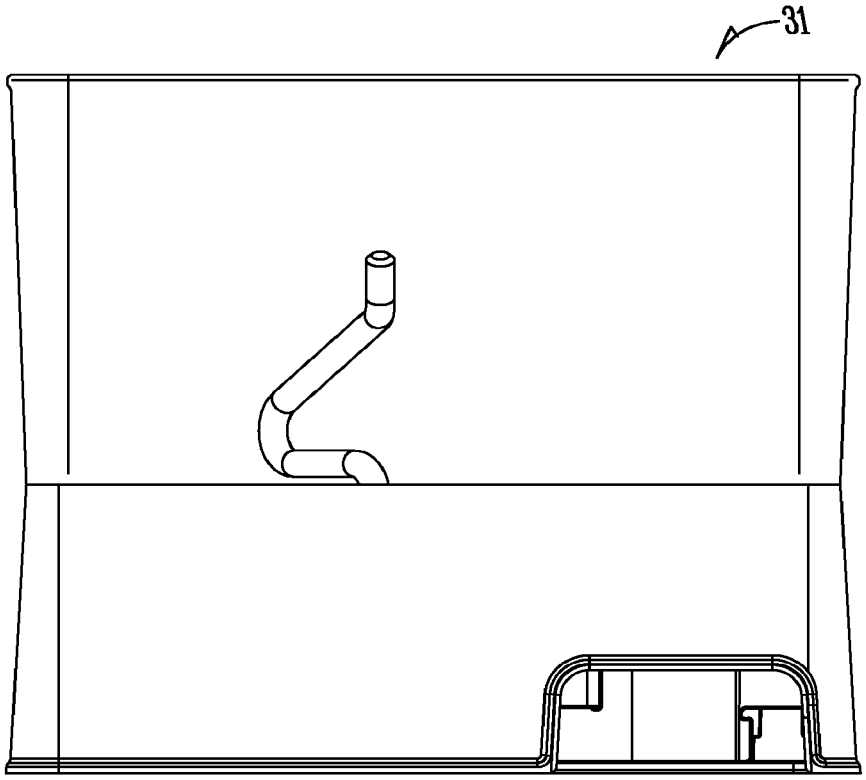
FIG. 7 is a front elevation view of the removable ice bucket of FIGS. 5 and 6 removed from the interior space of the ice container of FIGS. 5 and 6.

FIGS. 1A-1E illustrate one example of a French-door, bottom-freezer refrigerator 10 having an in-door insulated ice container 30 (FIG. 1B) that includes a two-plane door 34 (FIGS. 1B and E). Ice compartment 30 encloses a removable ice bucket 31 (FIG. 7) into which ice and sub-freezing temperature air can be directed via an ice maker 22 (FIGS. 1B, 3B, 4B, and 9). Icemaker 22 is mounted on the ceiling of the refrigerated food compartment in alignment with the top of in-door ice container 30.

As can be appreciated, this configuration for refrigeration appliance 10 allows ice to be automatically made, even though ice maker 22 is in the above-freezing cold food or refrigeration section of appliance 10. It also allows, when refrigerator door 14 is closed, ice to drop by gravity into ice bucket 31, which is substantially enclosed by insulated ice compartment 30.

Figure 4A:
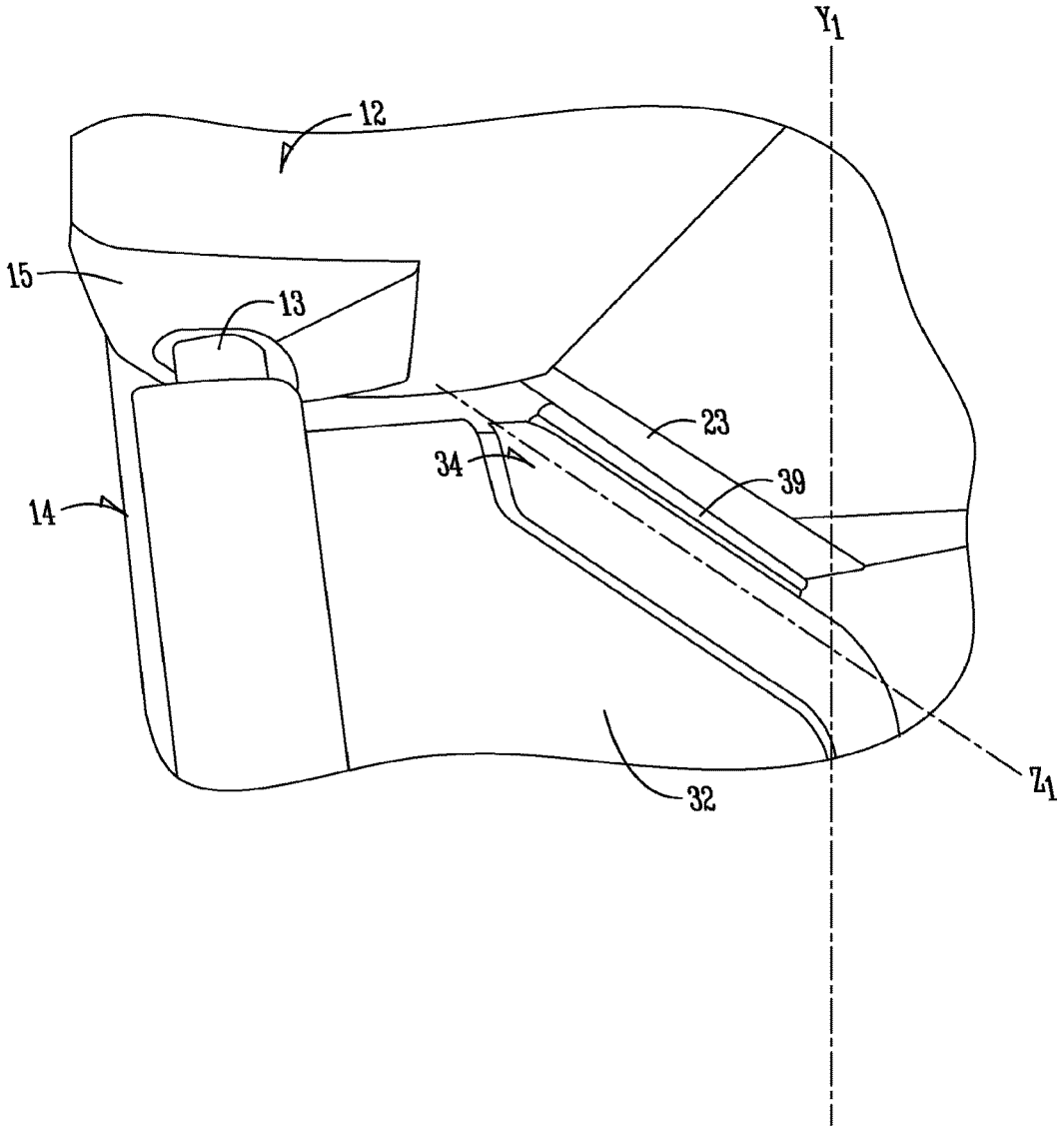
FIG. 4A is an enlarged isolated diagrammatic view of the top of the ice compartment of FIGS. 1B-E when the French door in which it is mounted is closed, showing how the angled top of the two-plane door of the ice compartment is in complementary abutment with the angled front of the ice maker of FIGS. 3A and B.
Figure 4B:
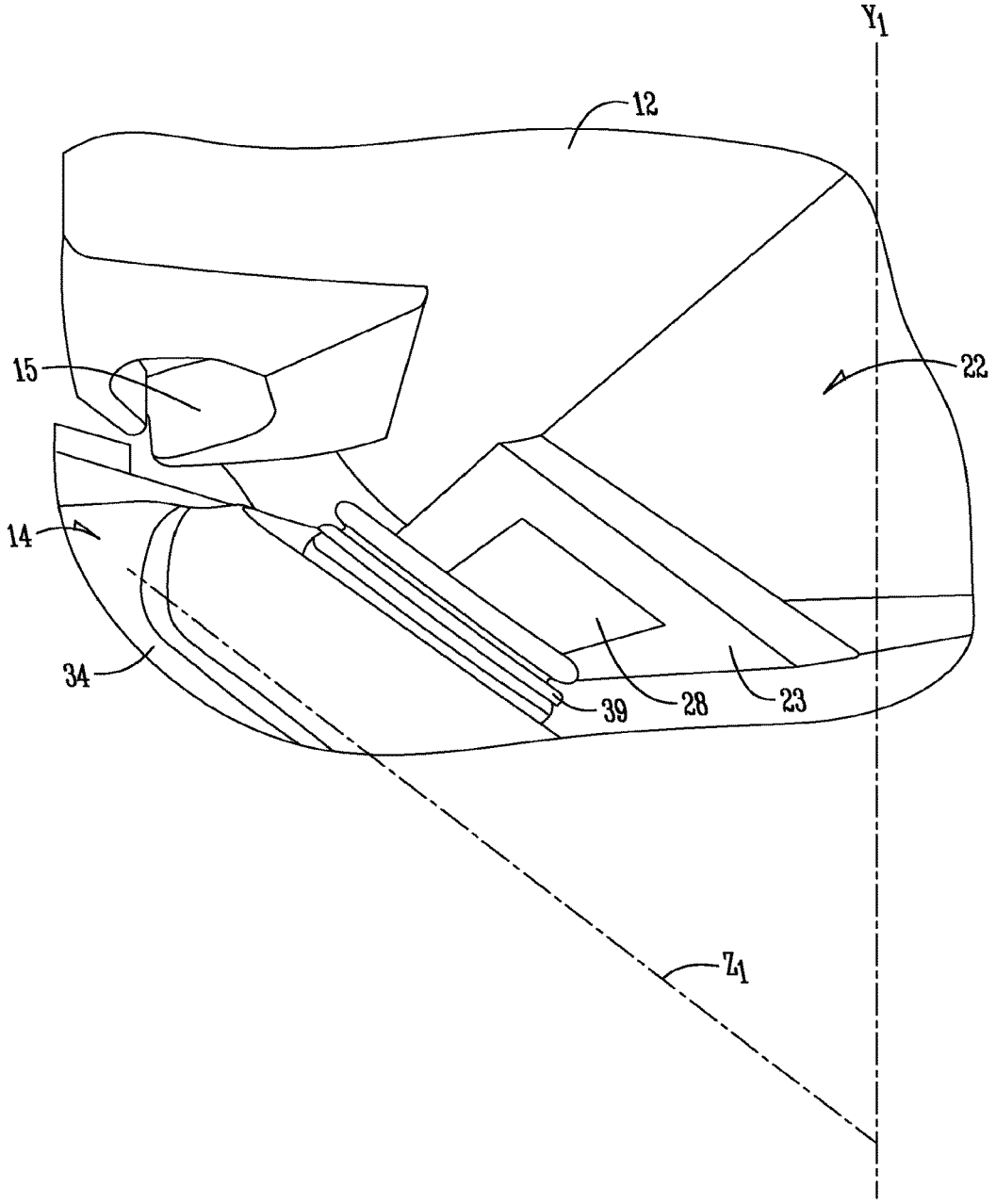
FIG. 4B is similar to FIG. 4A, but with the French door slightly opened to show how the two-plane door to the ice compartment separates from the angled face of the ice maker when the refrigerator French door is opened.
Figure 8:
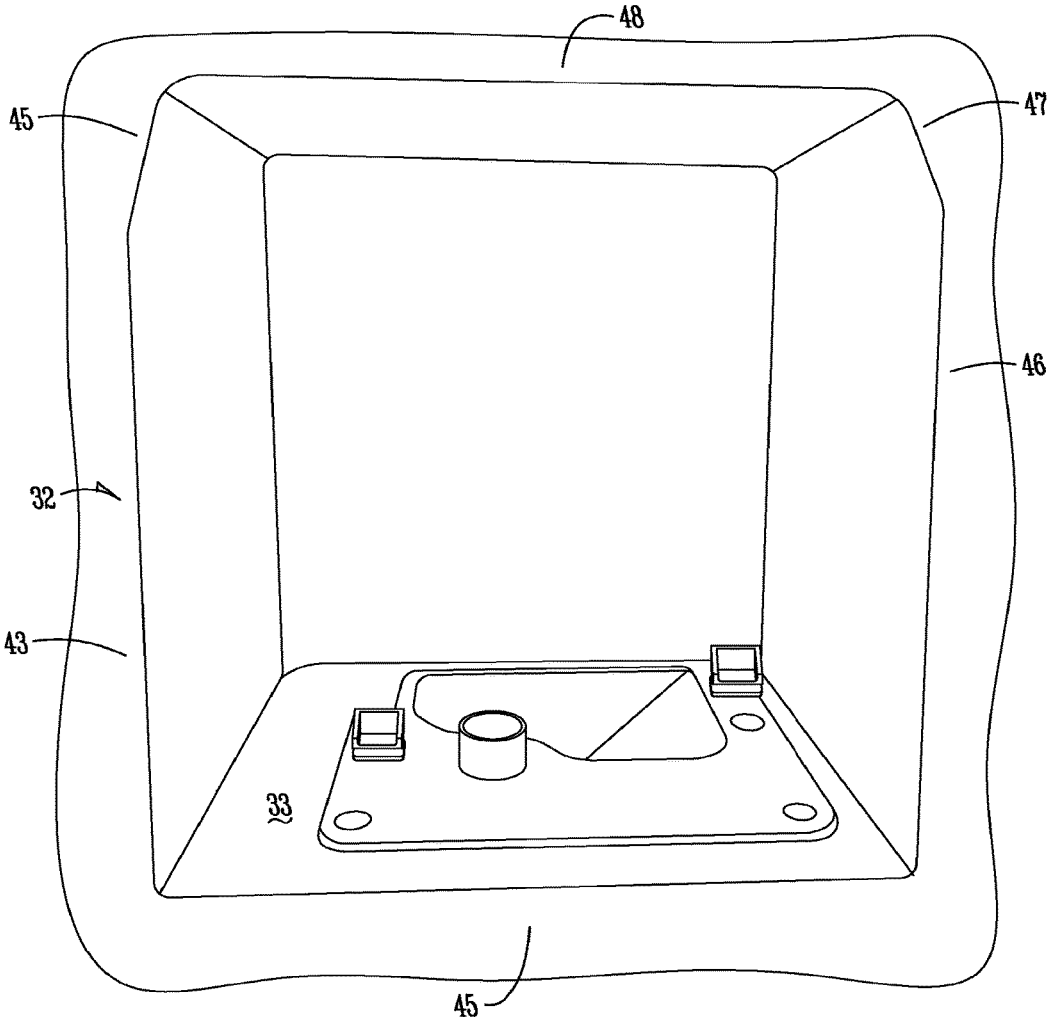
FIG. 8 is a perspective view of the internal space of the ice compartment with the ice bucket of FIG. 7 removed.

As indicated at FIGS. 1B, 4A and B, a large pin 13 (or analogous structure) at the top of door 14 adjacent ice container 30 mateably fits into a receiver 15 at the top center of the refrigerated food compartment to align and hold the angled top face 41 of ice compartment door 34 of ice compartment 30 against the complementary angled face 23 of ice maker 22 when refrigerator door 14 is closed (FIGS. 1B, 4A, 4B and 9). This promotes a good seal between angled face 23 and top face 41 of door 34, as well as a sealed pathways for ice to drop into ice bucket 31 and sub-freezing air into ice container 30 from conduit 26 (FIG. 3B) in the ice maker enclosure. This keeps interior space 33 (FIG. 8) of ice container 30 sub-freezing to maintain the state of ice in ice bucket 31. Even though ice bucket 31 is surrounded by above-freezing temperatures in the cold food section of refrigerated device 10, surrounding ice bucket 31 with insulated walls of ice container 30 allows freezing temperatures to be maintained inside ice compartment 30. This is the case even as French door 14 or 16 is opened from time to time to room temperature.

By appropriate methods, refrigerator 10 can sense the temperature inside of ice container 30 and supply needed sub-freezing air to maintain sub-freezing temperatures when French door 14 is closed.

A feature of ice compartment 30 is its front door 34. Ice compartment substantially encapsulates the space 33 it defines. Ice compartment door 34 is a part of the insulated walls of ice compartment 30.

Ice dispensed into ice compartment 30 from ice maker 22 can be made automatically available to ice/water dispenser 20 in refrigerator door 14. Components well-known in the art can automatically cause that ice or water dispersion. This provides a reason to store as much ice in ice bucket 31 as possible. It allows a reasonable and ready ice-on-demand supply for dispenser 20.

But there are times when access into ice compartment 30 is desirable. Examples include, but are not limited to, desire to obtain ice instead of through in-door dispenser 20, removable of all available ice in compartment 30, or cleaning or maintenance inside compartment 30. It should also be noted that some refrigerator models do not include an in-door ice/water dispenser 20. Access into ice compartment 30 would be necessary to extract ice.

Having a front door 34 allows access into space 33 of ice compartment 30. As indicated in the Figures, the angled top 41 of two-plane door 34 has an opening 38 surrounded by an accordion-type elastomeric seal 39 to facilitate sealing abutment to the face of the ice maker 22 (FIG. 4A). Thus, even though 38 opening would be uncovered and out of sealed communication with ice maker 22 when refrigerator door 14 is opened (FIG. 4B), insulation in the walls of ice container 30, the relatively small size of opening 38, and the normal short duration of having door 14 open, allow for reasonable maintenance of sub-freezing temperatures in ice container 30.

As can be appreciated from the Figures, two-plane door 34 has a major lower section 40 that exists in generally a vertical plane, and a top oblique section 41 in a plane at an angle between a 30° and 75° angle, or preferably between a 40° and a 50° angle or more preferably an approximate 45° angle from the plane of the major vertical section of ice compartment door 34. As can be further seen from the Figures, ice container or enclosure 30 has a body 32 that encloses the space 33 and has a complementary angling of the top of its opposite side walls, and a top wall that then goes back to approximately vertical.

Figure 2A:
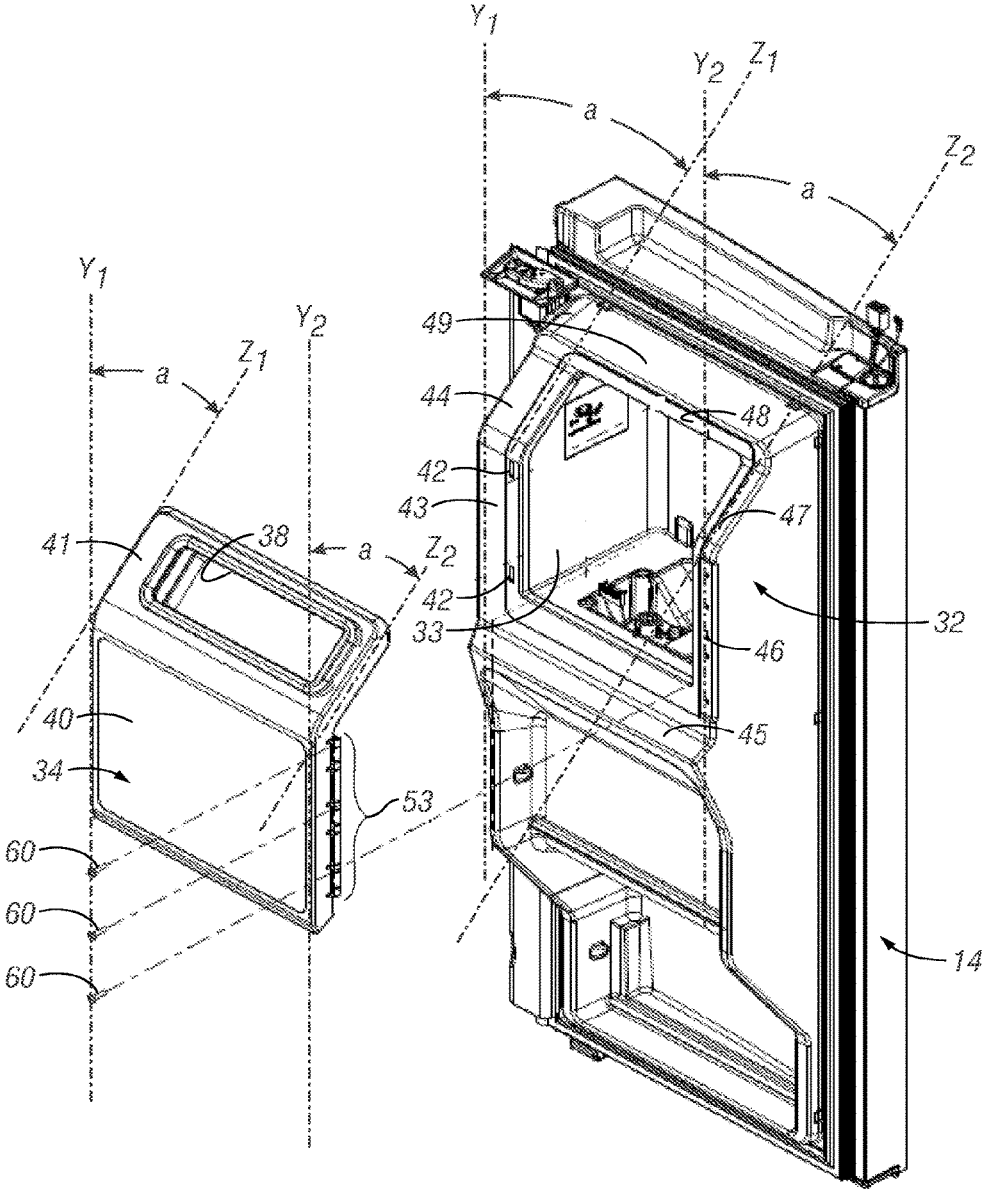
FIG. 2A is a detailed view of the ice compartment of FIGS. 1B-E with the two-plane door exploded from the remainder of the ice compartment and various reference lines illustrating the two planes of the door.
Figure 5:
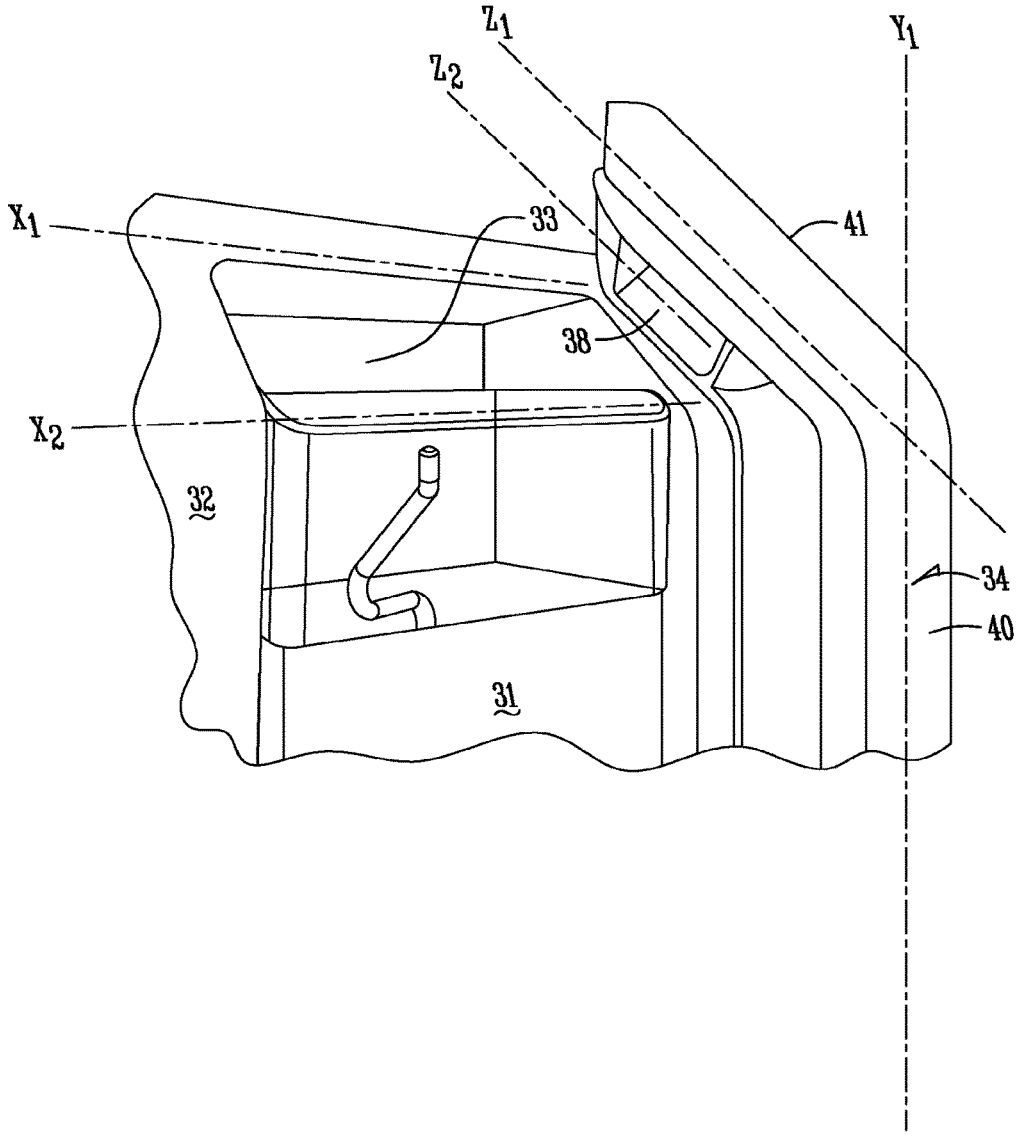
FIG. 5 is an isolated perspective view showing the two-plane door of the ice compartment in a slightly opened position, exposing a removable ice bucket in the space of the ice container.
Figure 6:
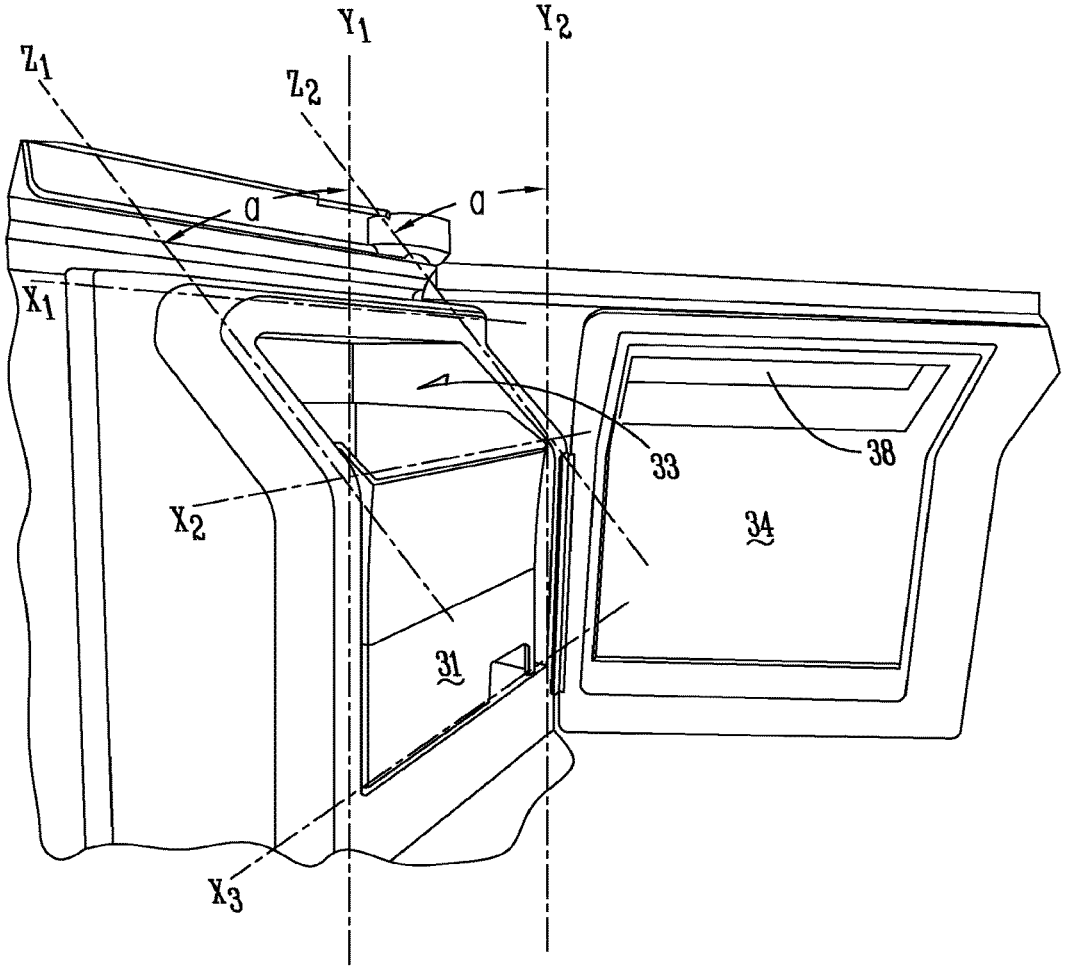
FIG. 6 is similar to FIG. 5, but shows the two-plane door to the ice compartment in a further opened position. Several axes are superposed on FIG. 6 to help illustrate the two general planes of the two-plane door relative to the front of the ice compartment.

The horizontal portion of two-plane door 34 has a hinge 53 along one side wall of ice container 30 (see FIG. 2A). A latch mechanism 36 is at the opposite side (see FIG. 2B). As shown in FIGS. 5 and 6 this allows door 34 to be pivoted open around a generally vertical pivot access on one side of ice container 30 to expose all of the interior space 33 of ice container 30. If an ice bucket (such as ice bucket 31 in the Figures) is inside ice compartment 33, two-plane door 34 allows for ice bucket 31 to be accessed to remove ice, break up ice, or simply view its contents. Alternatively, ice bucket 31 can be grasped and removed because the opening to compartment interior 33 is large when two-plane door 34 is hinged well open (FIG. 6).

When latched closed, two-plane door 34 follows the complementary perimeter features of body 32 of ice container 30 and essentially substantially encloses space 33.

As further seen in the Figures, ice container 30 is placed at the top inside of refrigerator door 14. Ice maker 22 is on the ceiling of the inside of cabinet 12 of refrigeration appliance 10. The angled complementary faces 41 and 23, respectively, of two-plane door 34 and ice maker 22 provide for good sealing abutment when refrigerator door 14 is closed. The angle interface promotes a good seal and deters leakage of sub-freezing air into the refrigerated food section of refrigerator cabinet 12. It also promotes a good seal to deter spillage of ice or ice pieces when falling from ice dispenser 22 into ice bucket 31.

Still further, it allows for some range of tolerance between the components and still promotes good seal and alignment between ice maker 22 and ice bucket 31. Pivoting of refrigerator door 14 around a vertical axis causes oblique face 41 of ice container 30 to move in generally a horizontal plane towards angled face 23 of stationary ice maker 22. Effective alignment and sealing is possible, with greater tolerance, than if those abutting surfaces were both vertical, or if both where horizontal (e.g. the horizontal top of an ice compartment rotated under a horizontal bottom of an ice maker).

Also, the two-plane door, its complementary opening to interior space 33 of ice compartment 30, and the angled face of ice maker 22 do not require substantial cost or complexity in design, materials, or assembly. They provide an effective way for gravity drop of ice from ice maker 22 into ice container 30 and, at the same time, a well-sealed air flow pathway for sub-freezing air from at or near ice maker 22 into ice compartment 30.

The angle also does not materially detract from efficient use of space inside refrigerator 10. It even provides improved access of a user's hands into the top of ice bucket 31 (as opposed to a configuration of vertical walls that would extend all the way to the top of the body of the ice compartment). Even though the angled top of two-plane door 34 does extend in an oblique plane over the top of ice bucket 31, and might be argued to give up some "head room" inside ice compartment 30, the pivot range of door 34 is such that it allows easy removal of ice bucket 31, which has a top level that is at or near the transition of the two planes of two-plane door 34.

The hinging mechanism 53 for two-plane door 34 extends only along the vertical lower edges of door 34 and ice container body 32, and not on the upper angled or oblique portions. This simplifies the hinge (e.g. it can be a piano-hinge type component which is simple and economical). Hinge 53 is, of course, made robust enough to handle the weight and forces of pivoting over at least the normal life span of a refrigerator.

The use of two hook-L-shaped latch pins 57 of latching mechanism 36 on the opposite vertical edge of two-plane door promotes good and repeatable latching of door 34 to container body 32 when door 34 is closed. Latch pins 57 fit into complementary slots 42 in body 32 of ice compartment 30. The hook ends of latch pins 57 extend first into and then down and hold two-plane door in a closed or latched position (sealed to ice compartment body 32). Latch handle 37 (FIG. 1E) at that side edge of ice container 30 can be lifted to move the hook ends of latch pins 57 vertically to then clear slots 42 to allow two-plane door to be easily opened or unlatched by the user.

It can therefore be seen that the two-plane door 34 of this embodiment provides benefits and advantages, some of which are subtle, some of which involve a balancing of sometimes antagonistic factors.

For example, two-plane door 34 does arguably add some complexity of shape and configuration to door 34 and ice compartment body 32 but this complexity is solved within this disclosure. It promotes good sealing and gravity-fall pathway alignment between ice maker 22 and the interior of ice compartment 30, with substantial tolerance in dimensions and alignment, without substantial complexity or expense.

Two-plane door 34 does arguably reduce available room inside ice compartment 30. But this is minimal and the oblique top promotes better user access to the interior of ice compartment 30.

The two-plane door does arguably increase issues regarding sealing of ice compartment 30, because of the relatively large size of door 34. But the large size allows for good access to the entire interior 33 of ice compartment 30. As discussed above, this allows, for example, an ice bucket that occupies most of interior 33 to be accessed and removed easily.

Specific Example of Two-Plane Door

Figure 2B:
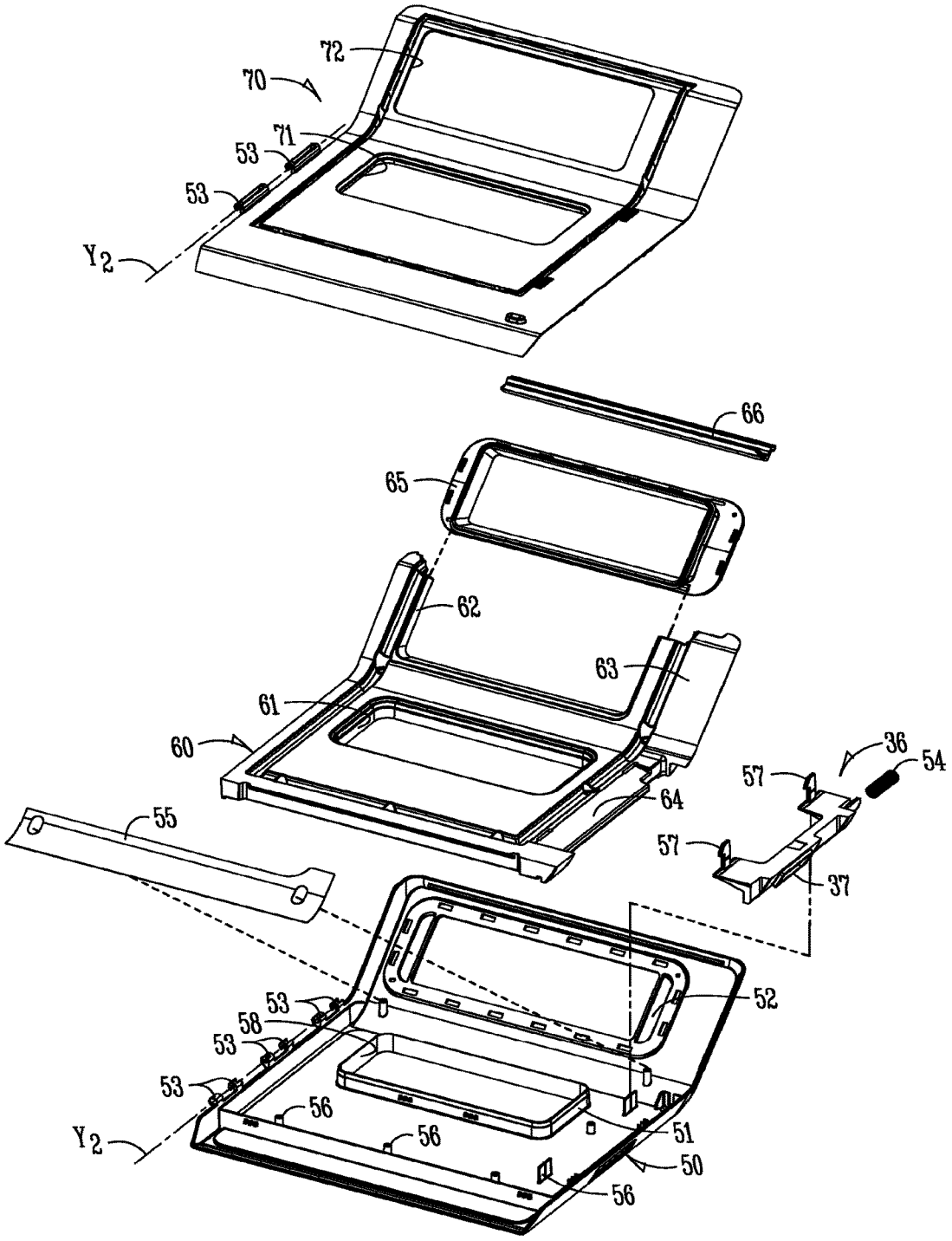
FIG. 2B is an exploded view of the components of just the two-plane door of FIG. 2A.

FIGS. 2A and 2B provide details regarding one example of a two-plane door 34. As diagrammatically illustrated in FIGS. 2A and B, the first plane of two-plane door 34 is the plane defined by lines y1 and y2 on door 34. The hinge or pivot axis for door 34 is along axis y2, which is parallel to line y1 at the opposite edge of door 34.

The second plane of door 34 is defined by lines z1 and z2 on door 34 (along opposite lateral edges of the top section of door 34). The angular offset of top section 42 of door 34 is at an angle a from the y1, y2 plane. As mentioned, in this embodiment, that angle is at or near 45° although it can vary. The area of the oblique opening to the front and top of ice container body 32 is generally defined by the overlap of planes x1, x2 and z1, z2 on ice container body 32; while the front-bottom area of the vertical opening to the interior of ice container 30 is defined by the overlap of planes y1, y2 and x2, x3 on ice container body 32 (see FIG. 6).

Figure 3A:
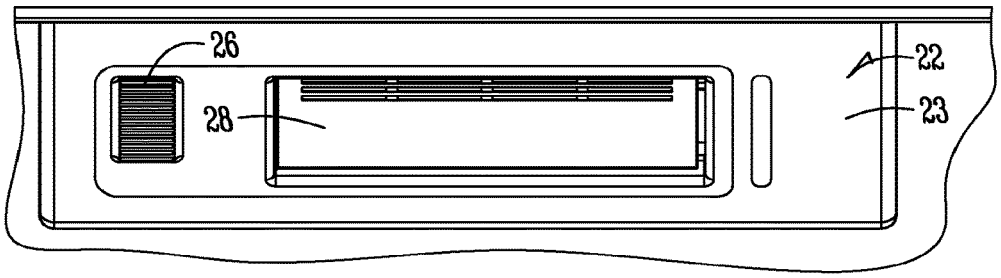
FIG. 3A is an isolated front view of the front complementary angled face of the automatic ice maker shown in FIG. 1B.
Figure 3B:
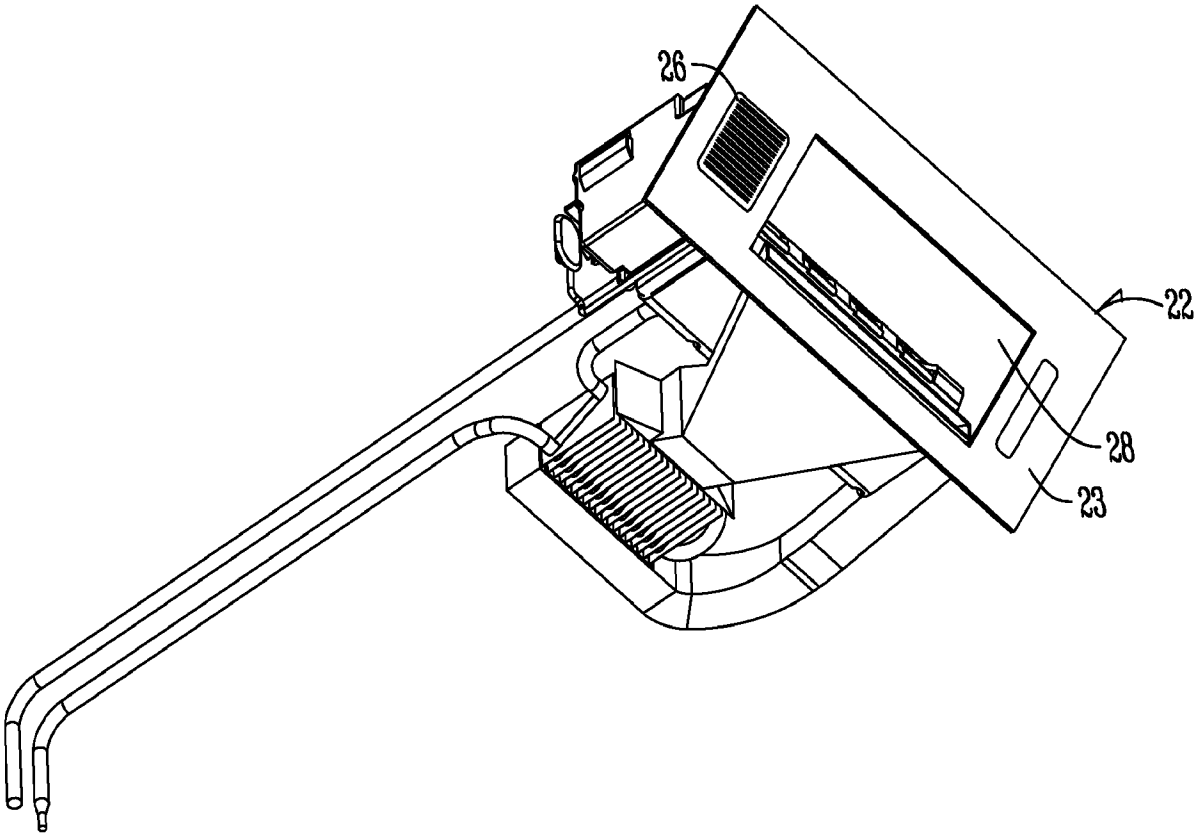
FIG. 3B is a perspective isolated view of the front face and other components of the ice maker of FIGS. 1B and 3A.

It should also be appreciated that opening 38 in portion 41 of door 34 is of a length and width that not only allows vertical dropping of ice from opening 28 of ice maker 22, but provides a pathway for sub-freezing air from air conduit 26 on the face 23 of ice maker 22 (FIG. 3A). Thus, that single opening 38 in two-plane door 34 provides that dual function. The accordion seal 39 around opening 38 is made of elastomeric material and in uncompressed normal state extends from the outer face of angled portion 41 of door 34. Gasket or seal 39 has the ability to compress. This provides a good sealing interface to face 23 of ice maker 22, especially when face 23 is brought close to the oblique front/top of door 34. This allows another aspect of dimensional tolerance between ice maker 22 and ice container 30.

FIGS. 2A and 2B illustrate to scale the size and configuration of a specific example of door 34. These dimensions are also in the context of a complementary opening into ice container body 32. As shown in FIG. 2A, that opening has a profile defined generally by horizontal bottom ledge 45, vertical left edge 43, angled back edge 44, a right vertical edge 46, the angled edge 47, and then a horizontal top edge 48 at the top wall 49 of ice container body 32.

Note that this embodiment places ice compartment 30, and thus two-plane door 34, to the top-most position on the inside of refrigerator door 14. Opening of door 34 to view or access, for example, ice bucket 31 inside ice compartment 30 would be approximately at chest or perhaps shoulder level for users of average height. This would allow easy grasping and removal of ice bucket 31 or easy viewing of contents of ice bucket 31. But the angled top 41 of door 34 would be higher and would not materially interfere with viewing or access of interior 33 when door 34 is opened. And it would allow a substantial sized ice bucket 31 to be thermally enclosed and insulated by ice compartment 30, including door 34 when closed. Also, the angled top of door 34 swings to alignment with angled face 23 of ice maker 22 at or near the very inside top of cabinet 12. Again, this interface is out of the way from interference with users and an efficient use of space to have that function. The angling of ice maker face 23 does not materially impede ice maker function or add substantial cost or complexity.

FIG. 2B shows the exemplary two-plane door 34 of FIG. 2A in exploded view. Door 34 can take different configurations. In this one embodiment, it has three main pieces—an outer half 50, an inner half 70, and a middle piece 60. When assembled those pieces 50, 60, and 70, are sandwiched together to form two plane door 34. This includes a manually actuatable latch 36 and a hinge 53. Outer half 50 includes a relatively smooth outer surface (FIG. 2A) but a depth defined by side walls. On that inner side of 50 are structures such as raised portions around opening 38 (see reference numeral 52 for one example), raised wall that would define opening 38 (reference numeral 51), and tabs 56 that can cooperate with middle piece 60 to snap fit or align them together. Note also a plate 55 is installed on corresponding pins on half 50 as a strengthening component.

Latch mechanism 36 includes a spring 54 and seats between outer half 50 and middle piece 60 and is held in position by bosses 56.

The middle piece 60 includes a receiver channel 62 for a plate 65 that helps define the opening 38 which would extend through each of pieces 50, 60, and 70 when door 34 is assembled. A strengthening member 66 is mounted, as shown. Surface 63 is wider than its opposite surface and fits in complementary fashion to outer half 50.

As indicated in FIGS. 2A and 2B, one way to mount door 34 to ice container body 32 so that it can pivot open is a piano-type hinge between one edge of door 34 and ice container body 32. In one example, hinge members 53 could be mounted to or even molded along an edge of door 34 (e.g. see members 53 in FIG. 2B, which when pieces 50, 60, and 70 of door 34 are assembled would all line up along pivot axis yPA). That would basically form one-half of a piano-style hinge. The other half of the hinge (e.g. see reference number 73 in FIG. 2B) can be screwed, bolted or otherwise fixed along vertical edge 46 of ice container body 32. A hinge pin 74 (shown in exploded form in FIG. 2B) can be extended through the piano-type hinge members of both door 34 and ice container body 32 when they are aligned along axis yPA to form a durable and robust hinge for door 34. The hinge can take various forms including other types. In this example hinge pin 74 could be a rigid metal rod, but could be made of other materials. Note that pivot axis yPA is offset slightly from axis y1 of door 34, but basically in plane y1-y2 of ice container body 32 (see FIG. 2A).

An option for door 34 is shown just in FIG. 2A. Corresponding openings 58, 61 and 71 can be formed in door pieces 50, 60, and 70 respectively. When pieces 50, 60, and 70 are assembled, these aligned openings collectively form a window in vertical part 40 of door 34. A pane (not shown) of glass, plastic, or other transparent or translucent material could be mounted spanning the opening. Such a window could allow a user to view into the interior of ice container 30 without opening door 34. This could be advantageous, for example, because it would allow a user to, inter alia, see if the ice bucket 31 is in place and, if so, how much ice is in ice bucket 31. Wall 51 would block foam from depositing on such a window.

Insulation (not shown), for example, expanding foam, can be injected between halves 50 and 70 after assembly to provide an improved thermal insulation factor for door 34 and adhere sections 50, 60, and 70 together into an integrated door 34. Door 34 then can be attached by screws 80 at hinge 53 to vertical surface 46 of in-door ice container 30. L-shaped latches 57 would fit into receiving apertures 42 on the opposite side of ice container body 32 and can be released by spring loaded handle 36. The vertically-spaced pair of latches 57 can promote a tight fit and seal of door 34 to the complementary opening to ice container 30 which door 34 covers.

This exemplary embodiment of door 34 balances cost (it is relatively economical), with thermal insulation properties (needed), with robustness. Many components can be made of plastic (economical). But strengthening components are added for longevity and robustness, and the foam both assists in robustness and thermal insulation properties. They can be made of plastic or strong, rigid materials such as metal. A window (see openings 61, 58, and 71) is optional.

Figure 9:
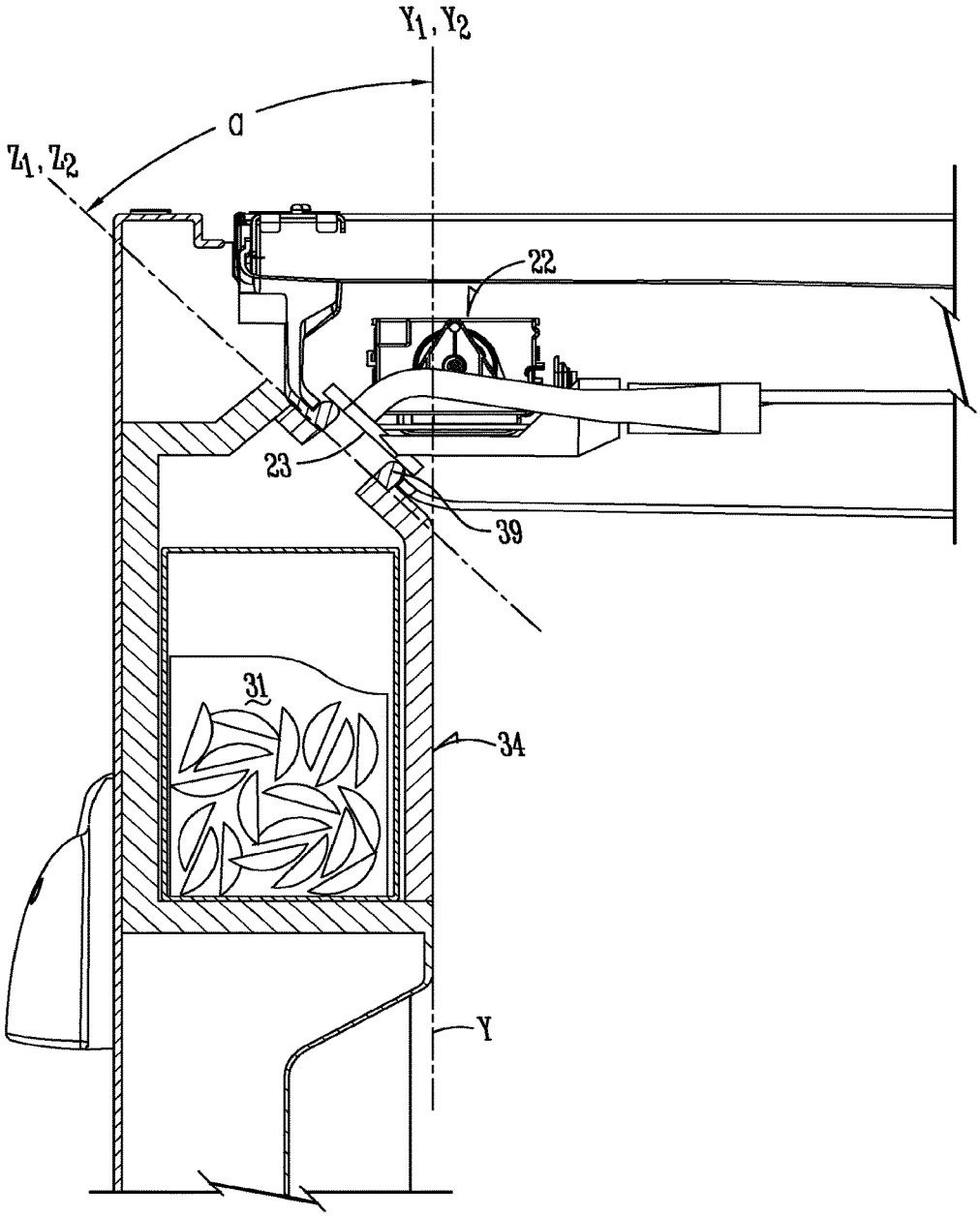
FIG. 9 is a diagrammatic side elevation sectional illustration of the two planes of the ice compartment door of FIG. 2B relative to the ice compartment, ice bucket and ice maker.

FIG. 9 illustrates diagrammatically the gravity-fall ice path and sub-freezing cold air path from ice maker 22 to ice bin 30 inside of ice container 30. It also shows the two planes of the two-plane door 34 and how it cooperates towards that end.

Alternatives & Options

It will be appreciated that the invention can take different forms and embodiments. The foregoing examples are neither exclusive nor inclusive of all the forms and embodiments the invention can take.

For example, the precise angle of offset of the two sections of the two-plane door 34 can vary (with appropriate adjustment of the corresponding portions of ice compartment body 32). The relative size of the two door sections can vary. The thickness of the door can vary. The exact type of hinge can vary. For example, it can be the more conventional piano-style hinge or could be, for example, a living hinge. Likewise different latches are possible.

As discussed earlier, two-plane door 34 could also be utilized for other containers in a refrigeration appliance.

Also, the two-plane door does not have to have any openings (like opening 38). It could be used to enclose a space without gravity drop of ice or a cold air pathway through the door (sub-freezing air could come into ice compartment 30 in a different location.

Still further, ice compartment does not have to be built into a refrigerator door. For example it could be completely self-contained and removable, with two-plane door providing access to its interior.

The precise materials can vary according to design and need. Typically in a refrigeration appliance, they are plastics or metals that comply with materials used in temperature ranges conventional with refrigeration appliances and with food products.

Another option would be to have a window or transparent section in door 34 so that the user can see the interior of ice container 30 without opening door 34 (see reference numbers 58, 61, and 71 in FIG. 2B).

What is claimed is:

1. An ice making system within a refrigerator comprising:
- a refrigerated compartment comprising a door for selective access to the refrigerated compartment;
- an icemaker located in the refrigerated compartment of the refrigerator and comprising an opening to allow formed ice to drop from the icemaker;
- an enclosure on the door and comprising an ice bin;
- a bin door rotatably attached to the door and having a lower portion and an upper portion located above the lower portion, wherein the lower portion follows a substantially vertical first plane, and the upper portion follows a second plane oblique to the first plane;
- an aperture in the upper portion disposed above the ice bin and substantially aligned with the opening.

2. The ice making system of claim 1 wherein the enclosure is held at a temperature below the freezing point of water.

3. The ice making system of claim 2 wherein the enclosure is an ice container.

4. The ice making system of claim 3 wherein the ice bin is removable.

5. The ice making system of claim 4 further comprising an ice maker in the cabinet in proximity to the ice container when the exterior door of the cabinet is closed.

6. The ice making system of claim 1 further comprising a seal between the aperture and the opening.

7. The ice making system of claim 1 wherein the first plane is substantially vertical and the second plane is about 45 degrees from the first plane.

8. The ice making system of claim 1 wherein the door hinge comprises a piano-style hinge.

9. A door for an ice compartment on the inside of a refrigerator comprising:
- an icemaker disposed in a refrigerated compartment of the refrigerator, the icemaker having a dispensing surface that is oblique to a horizontal plane of the refrigerator and an opening to allow formed ice cubes to drop through the opening;
- a refrigerator door providing selective access to the refrigerated compartment;
- an ice bin disposed on the door;
- an ice bin door hingedly mounted to the door and providing selective access to the ice bin, the ice bin door having a first section and a second section; wherein the first section is substantially on a vertical plane and the second section is on a plane oblique to the first plane and mates substantially with the dispensing surface;
- wherein the ice bin door further comprises an aperture in the second section disposed above the ice bin and substantially mates with the opening to allow formed ice cubed to drop into the ice bin.

10. The door of claim 9 wherein the opening is adapted to receive ice cubes or crushed ice by gravity.

11. The door of claim 9 wherein the opening is adapted to receive sub-freezing air flow.

12. The door of claim 9 wherein the opening is adapted to receive (a) ice cubes or crushed ice by gravity and (b) sub-freezing airflow.

13. The door of claim 9 further comprising a translation member along one side of the lower section to allow translation of the door body from a closed to an open position.

14. The door of claim 13 wherein the translation member comprises a hinge.

15. The door of claim 13 further comprising a latch between the first section and the refrigerated compartment along an opposite side of the ice bin door from the translation member.

16. A door for a refrigerator comprising:
- an enclosure comprising a removable ice bin;
- a bin door for providing selective access to the enclosure comprising:
  - a first section substantially on a vertical plane;

a second section at an angle oblique to the first section and disposed above the ice bin;

an aperture in the second section substantially aligned with an opening within the refrigerator to allow formed ice to pass through and into the ice bin.

17. The door of claim 16, wherein the door is disposed on a refrigerated compartment of the refrigerator.

18. The door of claim 17, further comprising an icemaker located in the refrigerated compartment, and wherein the opening is disposed on the icemaker to allow formed ice to pass through to the ice bin.

* * * * *